US005549963A

United States Patent [19]

Elgarhy et al.

[11] Patent Number: 5,549,963

[45] Date of Patent: Aug. 27, 1996

[54] POLYAMIDE MATERIALS WITH DURABLE STAIN RESISTANCE

[75] Inventors: Yassin M. Elgarhy, St. Eustache; Barry R. Knowlton, Concord, both of Canada

[73] Assignee: Trichromatic Carpet Inc., Quebec, Canada

[21] Appl. No.: 336,767

[22] Filed: Nov. 9, 1994

Related U.S. Application Data

[63] Continuation-in-part of Ser. No. 190,636, Feb. 2, 1994, Pat. No. 5,457,259.

[51] Int. Cl.[6] ..... C08L 61/14; C08L 61/06

[52] U.S. Cl. ..... 428/224; 428/245; 428/524; 428/477.4; 525/129; 525/141; 525/150; 525/158; 525/167

[58] Field of Search ..... 428/224, 245, 428/524, 477.4; 528/129, 141, 150, 158, 167

[56] References Cited

U.S. PATENT DOCUMENTS 4,822,373 4/1989 Olson et al. ..... 8/115.6

*Primary Examiner*—W. Robinson H. Clark
*Attorney, Agent, or Firm*—Bauer & Schaffer

[57] ABSTRACT

A treated fibrous polyamide substrate having durable resistance to staining by acid colorants comprising a fibrous polyamide substrate having applied thereto an aqueous solution of a partially sulfonated, partially phosphated resol resin; which aqueous solution may include polymethylmethacrylates or combinations thereof, and that may include a fluorochemical; and the method of treating said substrate, and the resol resins themselves.

17 Claims, No Drawings

POLYAMIDE MATERIALS WITH DURABLE STAIN RESISTANCE

This application is a continuation-in-part of application Ser. No. 08/190,636 filed Feb. 2, 1994 and now U.S. Pat. No. 5,457,259.

FIELD OF INVENTION AND PRIOR ART

Fibrous polyamide substrates, such as nylon carpeting are susceptible to staining by both naturally occurring and commercial acid colorants found in many common foods and beverages. The demand for reduced staining from such acid colorants has by and large been met by treatment with compositions comprising sulfonated naphthol- and/or sulfonated phenol-formaldehyde condensation products as disclosed for example in the following patents: U.S. Pat. Nos. 4,501,591 (Ucci and Blyth); 4,592,940 (Blyth and Ucci); 4,680,212 (Blyth and Ucci); and 4,780,099 (Greschler, Malone and Zinnato); or by treatment with compositions comprising sulfonated novolak resins together with polymethacrylic acid as disclosed in U.S. Pat. No. 4,822,373 (Olson, Chang and Muggli).

The initial stain resistant properties imparted to polyamide substrates, such as carpeting, that have been treated using the above mentioned compositions degenerates significantly with each wet cleaning the substrate receives. Improved stain resistance after wet cleaning can be achieved by increasing the amount of stain-resist product initially applied to the substrate. However, this generally leads to discoloration caused by yellowing of the substrate initially, and further discoloration results following exposure to oxides of nitrogen and/or light. This discoloration in most cases is attributed to dihydroxydiphenyl sulfone and its associated $SO_2$ group.

Stain-resist products currently available in the market place are generally novolak-type resins based on dihydroxydiphenyl sulfone condensed with phenol sulfonic acid or naphthalene sulfonic acid and an aldehyde in various proportions. The chemical structure of these resins may generally by depicted as follows:

(a) Condensation product of naphthalene sulfonic acid and dihydroxydiphenyl sulfone with formaldehyde

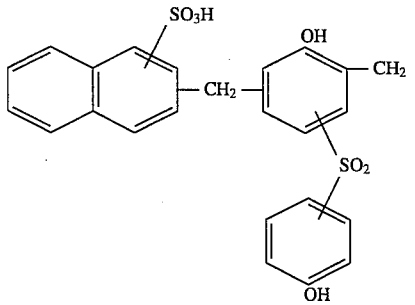

(b) Condensation product of phenolsulfonic acid and dihydroxydiphenol sulfone with formaldehyde

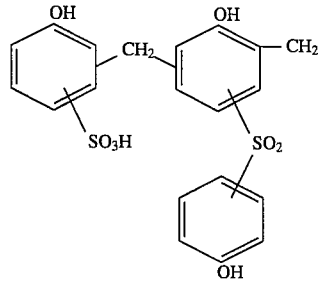

It is generally known that increasing the ratio of dihydroxydiphenol sulfone to phenol sulfonic acid or naphthalene sulfonic acid will increase the stain resist properties of the resin and subsequently cause a higher degree of yellowing or discoloration initially and further discoloration upon exposure to oxides of nitrogen and/or light. It is also evident that when the ratio of phenol sulfonic acid or naphthalene sulfonic acid to dihydroxydiphenyl sulfone is increased, the result is lowered stain-resist properties and less discoloration.

The addition of acrylic polymers and/or copolymers to the previously mentioned condensation products, as disclosed in U.S. Pat. No. 4,882,373 (Olson, Chang and Muggli), allows the use of a novolak resin condensate containing a high ratio of dihydroxydiphenol sulfone without adverse discoloration. This is achieved due to the dramatically reduced percentage of novolak resin in the product which is adjusted to obtain a desired maximum level of discoloration while maintaining a minimum level of durable stain resistance. The high level of initial stain resistance is supplied primarily by the acrylic polymers and/or copolymers and, after wet cleaning stain resistance is maintained by the novolak resin condensate, the acrylics having largely been removed during the wet cleaning process.

SUMMARY OF THE INVENTION

The novel composition developed according to the present invention, that is to say, the partially phosphated partially sulfonated resol resins supplemented if desired by the addition of a polymer or copolymer of a polymethylmethacrylate and/or a fluorochemical, when applied to fibrous polyamide substrates provide substrates that exhibit superlative resistance to staining by acid colorants, stain-resistant qualities that are not significantly impaired following repeated washing. It is to be noted too that the novel compositions according to the invention tend to minimize discoloration of the fibrous polyamide substrates both during manufacture and subsequently following exposure either to oxides of nitrogen or light.

The novel stain-blocking resin compositions according to the invention differ materially from stain-blockers of the prior art, many of which, as has been mentioned, rely on use of partially sulfonated novolak resins. The new resins are in fact resol resins heretofore unknown in the art, and are lighter in color than prior art novolak resins.

The series of reactions terminating in the preparation of the partially sulfonated and phosphated resins according to the invention runs as follows: condense phenol and sulfonated naphthalene in the presence of an aldehyde, preferably formaldehyde, in an alkaline medium, pH 9 to 10. Following the formaldehyde condensation the pH of the medium is adjusted to between 4 to 5, and a sulfonating agent such as sodium metabisulfite ($Na_2S_2O_5$) is added. The reaction leading to partial sulfonation of the phenol is continued for 1 to 2 hours at 105° C. The reaction mixture is then cooled to 50° C., phosphoric acid ($H_3PO_4$) is added, the temperature is raised to 90° to 105° C. and the phosphating reaction is continued for 1 to 2 hours.

The ratio of sulfonated naphthalene to phenol initially is between 0 and 40 percent, preferably 10 to 25 percent, sulfonated naphthalene to 75 to 90 percent phenol, by weight while the ratio of formaldehyde should be at least one mole of phenol to one mole HCHO, and may be 1.3:1.

The sulfonated naphthalene employed at the initial stage of the reaction may be any one of three naphthalene derivatives, namely, either the 1-, 2-, or 3-monosulfonic acid derivatives with the 2-monosulfonic derivative being preferred.

Sufficient $H_3PO_4$ is employed to assure between 5 and 15 percent, preferably 10 percent, by weight, phosphation. Following phosphation an alkaline solution is added to adjust the pH to between 5 and 6 and the solids content to between 30 and 40 percent, by weight, the alkali used being either sodium or potassium hydroxide.

The product is yellow to light brown in color, the color tending to darken on exposure to light or air, or to oxides of nitrogen, but color may be stabilized by the addition of a small amount of sodium formaldehyde-H-sulfoxylate, $NaHSO_2.HCHO.2H_2O$, at a pH below 7 and a temperature below 90° C. for 20 to 60 minutes, preferably 30 minutes, the quantity of the sulfoxylate being 0.1 to 4.0 percent, preferably 0.5 to 2.0 percent. The sulfoxylate treatment reduces color by 20 to 50 percent and prevents further discoloration.

The reaction scheme according to the invention may generally but without undue restriction be graphically illustrated as follows:

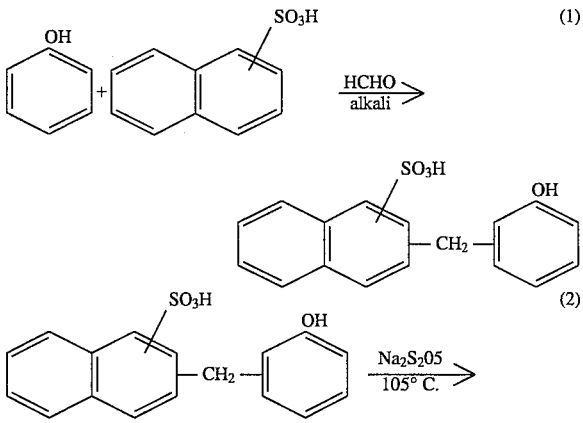

-continued

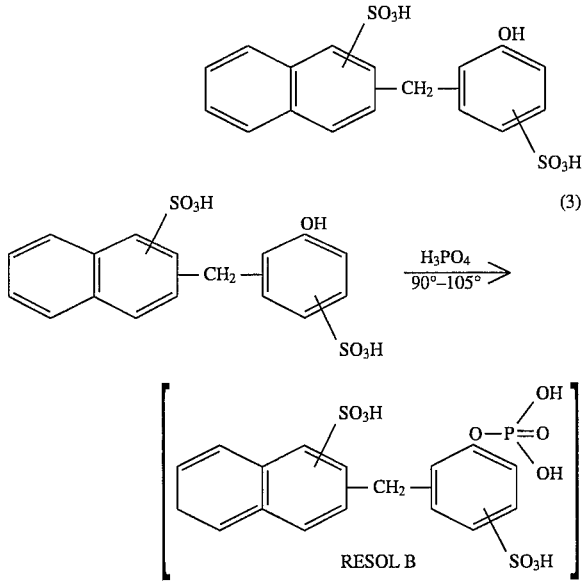

In the foregoing reaction the ratios of naphthalene sulfonic acid to phenol are, in weight percent, 1 to 40 percent naphthalene sulfonic acid to 60 to 99 percent phenol.

Where phenol alone is used without naphthalene sulfonic acid the phosphated structure should be

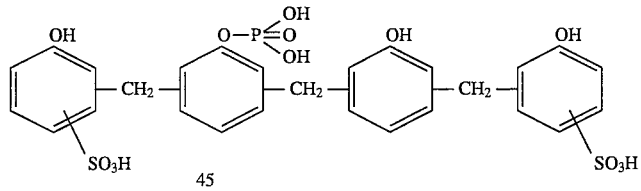

RESOL A

Additional structures that may be obtained during the reactions are as follows:

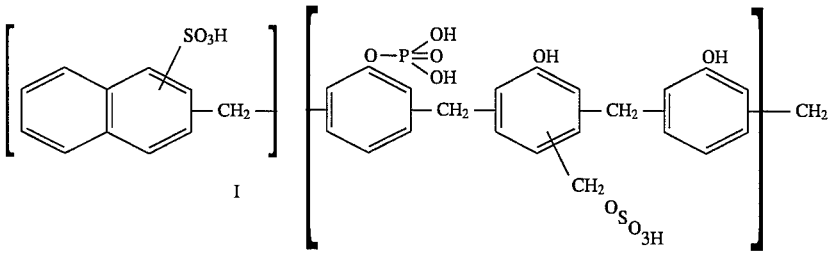

or

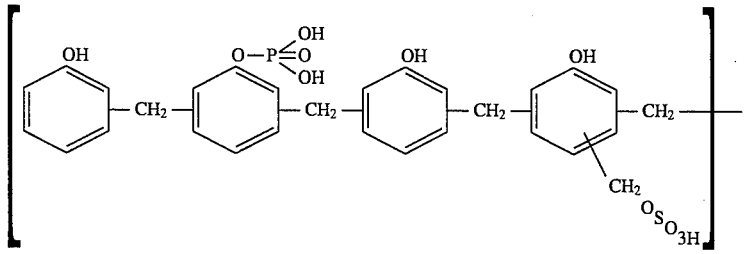

When phenol alone is used in the formulation of the resin, it has been discovered that the process of sulfonation and phosphation can be carried out simultaneously, rather than sequentially, in order to obtain the Resol A structure illustrated at the top of page 7 of the original disclosure. If, on the other hand, phenol is used in admixture with naphthalene sulphonic acid, the Resol B resin will be the result.

In either event, the reactions can be carried out as follows:

Condense either phenol and formaldehyde mole for mole, or a mixture of phenol, formaldehyde and naphthalene sulphonic acid, for about 60 minutes at a pH of 8 to 10 and a temperature of 90° to 110° C. Following condensation cool the mixture to between 50° and 60° C. and add sufficient phosphoric acid to obtain a pH of 3 to 4, add a sulfonating agent such as sodium metabisulfite ($Na_2S_2O_5$). Increase the bath temperature to between 90° and 95° C. and permit sulfonation and phosphation reactions to proceed simultaneously for 60 to 90 minutes yielding the desired modified resol resin, the resin having 3 to 7 percent phosphation and 30 to 50 percent sulfonation.

This alternative method provides a saving of about two hours of reaction time and enables the quantity of phosphoric acid to be reduced by at least 40 percent by comparison with the amount required according to the earlier disclosed method.

Following sulfonation and phosphation, water is added to the reaction bath along with a small quantity of sodium formaldehyde sulfoxylate for colour stabilization. The bath is cooled to between 30° and 70° C., stirred for 20 to 30 minutes and treated with either sodium or potassium hydroxide to adjust the pH to between 5 and 6. If necessary more water may be added to provide a solids content of 20 to 35 percent.

The procedures for testing and/or for the treatment of fibrous polyamides or wool are the same in both the earlier disclosed method and the alternate method. The modified resol resins obtained by either process may be mixed with acrylics and/or fluorochemicals as originally disclosed.

It has also been discovered that the addition of certain surfactants to the resol formulations improve the characteristics of the resols. Examples of surfactants that can be added are alkyl aryl sulfonates; ethoxylated alcohols; sulfonated caster oil; alkyl diaryl sulfonates; and alkyl sulfonates. Addition of one or more of the products mentioned will improve the penetration of the stainblockers especially on fibres pretreated with fluorochemicals. The surfactants are of value in preventing or reducing yellowing of the fibres when large quantities of stainblockers are used when nylon 6 is the fibre or when deep-dyeing nylon fibre. The surfactants also improve the solubility stability of stainblockers and the surface activity in strong acid solutions or in the presence of high quantities of salt in aqueous solution.

The present invention provides fibrous polyamide substrates, which exhibit improved resistance to staining by acid colorants after washing with detergent, that have had applied thereto a composition comprising a partially phosphated, partially sulfonated resol resin. That combination may include methacrylates such as polymers, and copolymers of polymethylmethacrylates or combinations thereof and may include a flurochemical.

Generally the resol products of this invention are applied to the polyamide substrate from an aqueous solution at a pH below 5 after the dyeing process. The resol products may be applied from an aqueous exhaust bath or by continuous application methods such as padding, foam, flooding or spray; all of which are well known to those skilled in the art.

Fluorochemical compositions for providing oil, water and soil repellency can also be applied in conjunction with the resol products of this invention.

Polymethylmethacrylates may also be applied in conjunction with the resol resins of this invention to further reduce or eliminate any likelihood of initial yellowing or of discoloration upon exposure to light or discoloration upon exposure to oxides of nitrogen.

TEST METHODS

In the test procedures and examples described below all percentages are by weight unless otherwise indicated, and the molecular weight (M.W.) is the weight average molecular weight.

INITIAL STAIN RESISTANCE ("IS")

A 5"×5" sample of the substrate to be tested is placed on a flat, non-absorbent surface. A two inch ring is placed on the sample and 20 ml of staining solution is poured into the ring and worked into the substrate. The ring is removed and the sample is left undisturbed for 24 hours at ambient temperature. The staining solution is prepared by dissolving 45 grams of cherry flavored KOOL-AID (trade mark) which contains Acid Red Dye No. 40, sugar-sweetened in 500 ml of water at 20° C. After 24 hours the sample is rinsed with cool tap water and dried.

The stain resistance of the sample is visually rated by assessing the amount of color remaining in the stained area by comparison with the unstained portion. The sample is rated on a scale from 1 to 8 wherein 8 is excellent stain resistance and 1 is poor stain resistance categorized as follows:

8=excellent stain resistance

7=good stain resistance

6=poor stain resistance

5=unacceptable staining

4=unacceptable staining

3=unacceptable staining

2=unacceptable staining

1=unacceptable staining

AFTER WET CLEANING STAIN RESISTANCE ("W.S.")

The sample to be tested is first immersed in a detergent solution containing 15 grams of DUPONOL WAQE (Trade Mark of E. I. DuPont de Nemours for a surface active agent based on lauryl sulfate per liter of water at a pH of 10 and at 20° C. for 15 minutes. The sample is removed from the detergent solution and rinsed thoroughly with cool tap water and dried. The staining solution is then applied and evaluated as set out in the initial stain resistance procedure.

INITIAL YELLOWING (DISCOLORATION) EVALUATION ("ID")

In the examples a graduated scale from 1 to 5 was used to evaluate yellowing where 5 represents no yellowing, 4 represents acceptable yellowing, and 3 or less represents unacceptable yellowing.

DISCLOSURE UPON EXPOSURE TO LIGHT ("LD")

In the examples a graduated scale from 1 to 5 was used to evaluate discoloration upon exposure to light where 5 represents no discoloration, 4 represents acceptable discoloration, and 3 or less represents unacceptable discoloration. Exposure to light was carried out according to AATCC test methods with an exposure time of 40 standard hours.

DISCOLORATION UPON EXPOSURE TO NITROUS OXIDES ("NO")

In the examples testing was performed according to AATCC test method 164-1992 and evaluated according to the number of test cycles completed by each sample before a gray scale rating of 4 was reached where the maximum number of cycles was 3. Thus a 3 cycle rating is superior to a 2 cycle rating and a 2 cycle rating is superior to a 1 cycle rating.

The following resol resins where prepared according to the preceding general disclosure for use in examples of this invention.

Resol "A"-derived from a solution containing 18%, by weight, phenol

Resol "B"-derived from a solution containing 16%, by weight, phenol and 2%, by weight, naphthalene sulfonic acid Resol resins combined with polymethylmethacrylates used in examples of this invention are of the following composition.

Resol 'A'/Acrylic "A"-55% by weight reson A combined with 45% by weight polymethylmethacrylates of 250,000 to 500,000 M.W.

Resol 'A'/Acrylic "B"-55% by weight resol A combined with 45% by weight polymethylmethacrylates of 40,000 to 80,000 M.W.

Resol 'A'/Acrylic "C"-55% by weight resol A combined with 45% by weight polymethylmethacrylates of 2,000 to 10,000 M.W.

Resol 'A'/Acrylic "D"-55% by weight resol A combined with 15% by weight polymethylmethacrylates of 250,000 to 500,000 M.W.

15% by weight polymethylmethacrylates of 40,000 to 80,000 M.W.

15% by weight polymethylmethacrylates of 2,000 to 10,000 M.W.

Resol 'B'/Acrylic "A"-55% by weight resol B combined with 45% by weight polymethylmethacrylates of 250,000 to 500,000 M.W.

Resol 'B'/Acrylic "B"-55% by weight resol B combined with 45% by weight polymethylmethacrylates of 40,000 to 80,000 M.W.

Resol 'B'/Acrylic "C"-55% by weight resol B combined with 45% by weight polymethylmethacrylates of 2,000 to 10,000 M.W.

Resol 'B'/Acrylic "D"-55% by weight resol B combined with 15% by weight polymethylmethacrylates of 250,000 to 500,000 M.W.

15% by weight polymethylmethacrylates of 40,000 to 80,000 M.W.

15% by weight polymethylmethacrylates of 2,000 to 10,000 M.W.

Commercially available stain resist products used for comparison with the products of the present invention are designated as follows:

Comparative stain resist A-FX661: a novolak, acrylic blend available from 3M Co.

Comparative stain resist B-FX369: a novolak resin available from 3M

Comparative stain resist C-Algard DP3 4694: a novolak resin available from Allied Colloids Inc.

The nylon 6 and 66 substrates used in examples of this invention were in cut pile carpet form that was processed through a dyeing cycle without dyestuffs being present so as to yield an uncolored substrate free of fibre lubricating oils. These substrates are designated as follows:

Nylon 66-Monsanto fibre type 1837, moist heat set

Nylon 6-BASF fibre, moist heat set

EXAMPLE 1

A treating solution was prepared containing 2.0% resol A based on the nylon 66 sample weight of 15 grams and exhausted onto the fibre at a liquor ratio of 15:1, at a pH of 2.5 and at 75° C. for a period of 20 minutes. The sample was then rinsed and dried.

EXAMPLE 2

A treating solution was prepared containing 4.0% resol A based on the nylon 6 sample weight of 15 grams and exhausted onto the fibre at a liquor ratio of 15:1 at a pH of 2.5 and at 75° C. for a period of 20 minutes. The sample was rinsed and dried.

EXAMPLE 3

A nylon 66 sample was prepared as in Example 1 except that 2.0% of resol B replaced resol A.

EXAMPLE 4

A nylon 6 sample was prepared as in Example 2 except that 4% of resol B replaced resol A.

EXAMPLE 5

A nylon 66 sample was prepared as in Example 1 except that 2% comparative stain resist B replaced resol A.

EXAMPLE 6

A nylon 6 sample was prepared as in Example 2 except that 4% comparative stain resist B replaced resol A.

EXAMPLE 7

A nylon 66 sample was prepared as in Example 1 except that 2% comparative stain resist C replaced resol A.

EXAMPLE 8

A nylon 6 sample was prepared as in Example 2 except that 4% comparative sample C replaced resol A.

Examples 1 through 8 were evaluated for initial stain resistance (IS) after wet cleaning stain resistance (WS), initial discoloration (ID), discoloration upon exposure to light (LD), and oxides of nitrogen (NO), the results being set forth in Table 1.

TABLE 1

| Example | I.S. | W.S. | I.D. | L.D. | N.D. |
|---|---|---|---|---|---|
| 1 | 8 | 7 | 3–4 | 3 | 2 |
| 2 | 8 | 7 | 3 | 3 | 2 |
| 3 | 8 | 7 | 3–4 | 3–4 | 2 |
| 4 | 8 | 6 | 3–4 | 3 | 2 |
| 5 | 8 | 6 | 3–4 | 3 | 1 |
| 6 | 8 | 5 | 3 | 2–3 | 1 |
| 7 | 7 | 5 | 4–5 | 4–5 | 2 |
| 8 | 6 | 4 | 4 | 4 | 2 |

As can be seen from the data in Table 1, the polyamide substrates treated with resol resins of this invention (examples 1 to 4) generally demonstrate a higher initial stain resistance and stain resistance after wet cleaning than comparative novolak resins (examples 5 to 8). It is also apparent that certain novolak resins, although demonstrating inferior to unacceptable stain resistance, do exhibit less discoloration initially and upon exposure to light (examples 7 & 8). The resol resins of this invention (examples 1 to 4) also demonstrate equivalent or less discoloration upon exposure to oxides of nitrogen with respect to comparative novolak resins (examples 5 to 8).

EXAMPLE 9

A treating solution was prepared containing 4.0% resol A/Acrylic A blend based on a nylon 6 sample weight of 15 grams and exhausted onto the fibre at a liquor ratio of 15:1 at a pH of 2.5 and at a temperature of 75° C. for a period of 20 minutes. The sample was rinsed and dried.

In examples 10 through 17, nylon 6 samples were prepared and treated as in Example 9 except the stain resist compounds used were as set forth in Table 2.

TABLE 2

| Example | Stain Resist Compound |
|---|---|
| 10 | Resol 'A'/Acrylic 'B' |
| 11 | Resol 'A'/Acrylic 'C' |
| 12 | Resol 'A'/Acrylic 'D' |
| 13 | Resol 'B'/Acrylic 'A' |
| 14 | Resol 'B'/Acrylic 'B' |
| 15 | Resol 'B'/Acrylic 'C' |
| 16 | Resol 'B'/Acrylic 'D' |
| 17 | Comparative stain resist A |

Examples 9 through 17 were evaluated for initial stain resistance, after wet cleaning stain resistance, initial discoloration, discoloration upon exposure to light and oxides of nitrogen, the results being set forth in Table 3.

TABLE 3

| Example | W.S. | I.D. | L.D. | N.D. | N.D. |
|---|---|---|---|---|---|
| 9 | 8 | 5 | 5 | 5 | 3 |
| 10 | 8 | 5 | 5 | 5 | 3 |
| 11 | 8 | 5–6 | 5 | 4–5 | 3 |
| 12 | 8 | 5 | 5 | 5 | 3 |
| 13 | 8 | 4 | 5 | 5 | 3 |
| 14 | 8 | 5 | 5 | 5 | 3 |
| 15 | 8 | 5 | 5 | 4–5 | 3 |
| 16 | 8 | 5 | 5 | 5 | 3 |
| 17 | 8 | 4 | 5 | 4–5 | 2 |

As can be seen from the data in Table 3, the polyamide substrate treated with resol resins of this invention combined with polymethylmethacrylates (Examples 9 to 16) demonstrate significant improvements in initial discoloration, discoloration upon exposure to light and oxides of nitrogen when compared to the uncombined resol resins of Examples 1 to 4. It is also apparent that resol resins combined with polymethylmethacrylates of this invention (Examples 9 to 16) exhibit lower stain resistance ratings after wet cleaning as compared to the uncombined resol resins of Examples 1 to 4. Resol resins of this invention combined with polymethylmethacrylates in Examples 9 through 16 in all examples demonstrate superior or equal properties to comparative sample 17 which is a novolak resin combined with acrylic polymer.

For Examples 18 and 19 resol resin A was combined with polymethylmethacrylate blends as follows:

EXAMPLE 18

Resol 'A'/Acrylic "E"-25% by weight resol "" combined with

25% by weight polymethylmethacrylates of 250,000 to 500,000 M.W.

25% by weight polymethylmethacrylates of 40,000 to 80,000 M.W.

25% by weight polymethylmethacrylates of 2,000 to 10,000 M.W.

EXAMPLE 19

Resol 'A'/Acrylic "F"-70% by weight resol "A" combined with

10% by weight polymethylmethacrylates of 250,000 to 500,000 M.W.

10% by weight polymethylmethacrylates of 40,000 to 80,000 M.W.

10% by weight polymethylmethacrylates of 2,000 to 10,000 M.W.

In Example 18, a treating solution was prepared containing 4.0% resol 'A'/acrylic "E" blend, as previously described, based on a nylon 6 sample weight of 15 grams and exhausted onto the fibre at a liquor ratio of 15:1 at a pH of 2.5 and at a temperature of 75° C. for a period of 20 minutes, the sample was rinsed and dried.

Example 19 was prepared and treated as in Example 18 except the stain resistant resol 'A'/acrylic "F" blend as previously described was used to replace stain resistant resol 'A'/acrylic "E" blend.

Examples 18 and 19 were tested and reported in Table 4 along with data from Examples 2, 12 and 17 for comparative purposes.

TABLE 4

| Example | I.S. | W.S. | I.D. | L.D. | N.D. |
|---|---|---|---|---|---|
| 18 | 8 | 4–5 | 5 | 5 | 3 |
| 19 | 8 | 6–7 | 5 | 4–5 | 2 |
| 2 | 8 | 7 | 3 | 3 | 2 |
| 12 | 8 | 5 | 5 | 5 | 3 |
| 17 | 8 | 4 | 5 | 4–5 | 2 |

As can be seen from the data in Table 4, the polyamide substrates of Examples 18, 19 and 12 treated with resol resin containing various proportions of polymethylmethacrylates of blended molecular weights exhibited superior stain resistance after wet cleaning when compared to the novolak/acrylic of comparative Example 17 and inferior stain resistance after wet cleaning when compared to 100% resol "A" of Example 2. Furthermore the blended resol/acrylics of Examples 12 and 18 exhibited superior performance upon exposure to nitrous oxides when compared with the comparative novolak/acrylic blend of Example 17. It is also noted that when the proportion of polymethylmethacrylates present in the resol resin in approximately a ratio of 1:1 as in Example 12 optimum results are obtained with respect to stain resistance after wet cleaning, initial discoloration and discoloration upon exposure to light and oxides of nitrogen when compared to comparative example 17.

Comparisons of Examples 2, 12, 18 and 19 demonstrate that as the concentration of resol resin to polymethylmethacrylates is reduced a) the stain resistance after wet cleaning is reduced and b) the propensity for discoloration from tested sources is also reduced.

EXAMPLE 20

A treating solution containing 75 g/L. Resol 'A'/Acrylic 'D' blend and 50 g/L Milease* F15N, a non ionic fluorochemical available from I.C.I., U.S.A. plus 20 g/L. Alkafoam D, a foaming agent available from Alkaril Chemicals, Inc., and having a pH of 4 using acetic acid was prepared and foamed onto a sample of nylon 66 carpet using a blow ratio of 60:1 and a wet pick up of 20% to provide an application rate of 1.5% Resol 'A'/Acrylic 'D' plus 1% fluorchemical based on the weight of the sample. The sample was dried at 120° C. for 20 minutes. The treated sample was tested with results as set forth in Table 5 along with results from Example 12 Resol 'A'/Acrylic 'D' without fluorochemical.

*Trademark

TABLE 5

| Example | I.S. | W.S. | I.D. | L.D. | N.D. |
|---|---|---|---|---|---|
| 18 | 8 | 6 | 5 | 5 | 3 |
| 12 | 8 | 5 | 5 | 5 | 3 |

Example 18 containing Resol 'A'/Acrylic 'D' and a fluorochemical demonstrated no adverse affects due to the presence of fluorochemical when compared with Example 12 which did not contain a fluorochemical. It should be noted that less stain resistant chemical is required when directly applied to the substrate via foam methods, when compared to indirect application via exhaust methods.

EXAMPLE 21

A treating solution containing 75 g/L Resol resin B and 50 g/l of Milease* F15N a non ionic fluorochemical available from I.C.I., U.S.A. plus 20 g/L Alkafoam D, a foaming agent available from Alkaril Chemicals, and having a pH of 4 using acetic acid was prepared and foamed onto a sample of nylon 66 carpet using a blow ratio of 60:1 and a wet pick up of 20% to provide an application rate of 1.5% resol resin 'B' plus 1% fluorochemical based on the weight of the sample. The sample was dried at 120° C. for 20 minutes. The treated sample was tested with results as set forth in Table 6 along with results from Example 3 Resol 'B' containing no fluorochemical.

*Trademark

TABLE 6

| Example | I.S. | W.S. | I.D. | L.D. | N.D. |
|---|---|---|---|---|---|
| 21 | 8 | 7 | 3–4 | 3–4 | 2 |
| 3 | 8 | 7 | 3–4 | 3–4 | 2 |

Example 21 containing Resol 'B' resin and a fluorochemical demonstrated no adverse affects due to the presence of a fluorochemical when compared with example #3 containing only Resol Resin 'B'. It should be noted that less stain resist chemical is required when directly applied to the substrate via foam methods when compared to indirect application via exhaust methods.

We claim:

1. The method of making a modified resol resin comprising reacting a member of the group: phenol, and phenol in admixture with a sulfonated naphthalene in the presence of an aldehyde, in an alkline medium, to form an aldehyde condensate, adjusting the pH to below 7 and further sulfonating the condensate with a sulfonating agent such as sodium metabisulfite, cooling the reaction mixture to 50° C., adding phosphoric acid, raising the temperature to about 100° C. and continuing the reaction for 1 to 2 hours in order to accomplish the desired degree of phosphation.

2. The method according to claim 1, the member of the group being reacted in the presence of the aldehyde being phenol in admixture with a sulfonated naphthalene.

3. The method according to claim 1, the member of the group being reacted in the presence of the aldehyde being phenol alone.

4. The method according to claim 2, the aldehyde being formaldehyde.

5. The method according to claim 3, the aldehyde being formaldehyde.

6. The method according to claim 4, the naphthalene being naphthalene 2-monosulfonic acid and the level of phosphation being between 5 and 15 percent.

7. The method according to claim 5, the phenol being both sulfonated and phosphated, the level of phosphation being 10 percent.

8. A modified resol resin prepared according to claim 1.

9. A modified resol resin prepared according to claim 6.

10. A modified resol resin prepared according to claim 7.

11. The method of making a modified resol resin comprising reacting a member of the group: (i) phenol, and (ii) phenol in admixture with a sulfonated naphthalene with an aldehyde in alkaline medium at a temperature of 90° to 110° C. to form a resol resin, cooling the medium, adjusting the pH to below 7, raising the temperature to above 90° C. and by the use of sulfonating agent and phosphoric acid sulfonating and phosphating the resol resin, the sulfonation and phosphation proceeding (a) simultaneously of (b) sequentially.

12. The method according to claim 11 wherein sulfonation and phosphation proceed simultaneously.

13. The method according to claim 11 wherein sulfonation and phosphation proceed sequentially.

14. The method according to claim 11 wherein following the formation of the resin and the cooling of the medium, adjusting the pH with phosphoric acid, and wherein the sulfonating agent is sodium metabisulfite.

15. The method of making a modified resol resin comprising reacting a member of the group: (i) phenol and (ii) phenol in admixture with a sulfonated naphthalene, with an aldehyde, in alkaline medium to form a resol resin, adjusting the pH of the medium to below 7 using phosphoric acid, cooling the medium, adding a sulfonating agent, raising the temperature to above 90° C. for a period of time sufficient to phosphate and sulfonate the resin.

16. The method according to claim 15, the member of the group being phenol, the aldehyde being formaldehyde and the sulfonating agent being sodium metabisulfite.

17. The method of treating a fibrous polyamide substrate, to render it durably resistant to staining by acid colourants; comprising applying to the substrate material a solution comprising a partially sulfonated, partially phosphated resol resin together with a surfactant selected from the group: alkyl aryl sulfonates; ethoxylated alcohols; sulfonated castor oil; alkyl diaryl sulfonates; and alkyl sulfonates.

* * * * *